US007124765B2

(12) United States Patent
Marks

(10) Patent No.: US 7,124,765 B2
(45) Date of Patent: Oct. 24, 2006

(54) DISHWASHER HAVING A WATER SOFTENER WITH A SALT CONTAINER LOCATED IN THE DISHWASHER DOOR

(75) Inventor: Volker Marks, Bielefeld (DE)

(73) Assignee: Miele & Cie, KG, Guetersloh (DE)

( * ) Notice: Subject to any disclaimer, the term of this patent is extended or adjusted under 35 U.S.C. 154(b) by 219 days.

(21) Appl. No.: 10/799,489

(22) Filed: Mar. 12, 2004

(65) Prior Publication Data

US 2004/0177654 A1 Sep. 16, 2004

(30) Foreign Application Priority Data

Mar. 12, 2003 (DE) ..... 103 11 126

(51) Int. Cl.
*B08B 3/00* (2006.01)

(52) U.S. Cl. ..... 134/93; 134/56 D; 222/181.3; 222/173; 222/184

(58) Field of Classification Search ..... 134/93; 222/181.3
See application file for complete search history.

(56) References Cited

U.S. PATENT DOCUMENTS

| | | | | |
|---|---|---|---|---|
| 2,122,900 | A * | 7/1938 | Uhrmacher | 423/208 |
| 3,339,737 | A * | 9/1967 | Kiscellus et al. | 210/134 |
| 3,342,336 | A * | 9/1967 | Rose | 210/134 |
| 3,363,637 | A * | 1/1968 | Rumbaugh et al. | 134/109 |
| 3,386,454 | A * | 6/1968 | Kendt | 134/58 D |
| 3,553,401 | A * | 1/1971 | Janecke | 200/81 R |
| 4,307,742 | A * | 12/1981 | Schrott | 134/115 R |
| 5,133,487 | A * | 7/1992 | Russi | 222/651 |
| 5,389,344 | A * | 2/1995 | Copeland et al. | 422/264 |
| 6,766,812 | B1 * | 7/2004 | Gadini | 134/56 D |

FOREIGN PATENT DOCUMENTS

| | | | |
|---|---|---|---|
| DE | 1859591 | | 10/1962 |
| DE | 1883789 | * | 11/1963 |
| DE | 1428445 | | 1/1969 |
| DE | 3209563 | * | 9/1983 |
| DE | 3209501 | * | 10/1983 |
| DE | 8511185 | | 7/1985 |
| DE | 3529131 | A1 * | 2/1987 |
| DE | 3829620 | * | 3/1990 |
| DE | 4036046 | | 5/1992 |
| DE | 4100067 | | 6/1992 |
| DE | 10204548 | | 8/2003 |
| EP | 0367062 | A1 * | 5/1990 |

* cited by examiner

*Primary Examiner*—Michael Barr
*Assistant Examiner*—Sarah E. Husband
(74) *Attorney, Agent, or Firm*—Darby & Darby

(57) ABSTRACT

A dishwasher includes a door, a washing tub closable by the door, and a water softener including an ion exchanger and a salt container. The salt container is disposed in an area of the door and includes a first and a second side wall, a bottom, narrow connecting walls, a water inlet and a brine outlet. Two side walls are disposed in the salt container, the dividing walls extending from the side walls to the bottom, dividing the salt container into a water distribution duct including the water inlet, a salt chamber, and a brine collecting duct including the brine outlet. The dividing walls, each including a respective screen surface in a region adjacent to the bottom, separate the water inlet and a brine outlet from each other. The screen surfaces are arranged in a v-shape relative to each other.

6 Claims, 4 Drawing Sheets

DISHWASHER HAVING A WATER SOFTENER WITH A SALT CONTAINER LOCATED IN THE DISHWASHER DOOR

Priority is claimed to German patent application DE 103 11 126.3, the subject matter of which is hereby incorporated by reference herein.

The present invention relates generally to dishwashers, and in particular to a dishwasher having a washing tub which is closable by an appliance door, the appliance door including at least two flat components that are spaced apart in at least one region; the dishwasher further including a water softener having an ion exchanger and a salt container, the salt container being a flat component which includes two side walls, a bottom, and narrow connecting walls and is located in the space between the two components of the appliance door; and the salt container having a water inlet and a brine outlet which are separated from each other by at least one screen surface.

BACKGROUND

A dishwasher having an ion exchanger and a salt container is known from German Patent Application DE 102 04 548 A1.

To prevent lime deposits on the dishes, it is known to soften the raw water flowing into the washing tub of a dishwasher using an ion exchanger. In household dishwashers, the ion exchanger generally contains a mixed bed resin whose softening components become exhausted and then have to be regenerated by a solution of common salt. To accommodate a supply of salt that lasts for several regeneration cycles, a water softener therefore contains a salt container in addition to the ion exchanger. In commercial dishwashers, it is generally known and a common practice to arrange the salt container in the bottom space of the appliance housing and to fill it through an opening in the bottom plate of the washing tub. However, this is uncomfortable for the user because he/she must reach far into the washing tub. An even greater disadvantage arises if a lack of salt is noticed when the appliance is loaded. In this case, it is first necessary to unload the lower dish rack to be able to remove it from the washing tub, and to thereby gain free access to the fill opening of the salt container. To avoid these disadvantages, German Patent Application DE 102 04 548 A1 proposes to arrange the salt container in the appliance door, thereby allowing it to be easily filled through an opening on the inside of the door. Due to the small amount of space between the outside door panel and the inside door panel, such a salt container must have a very flat design. To nevertheless allow the container to hold a quantity of salt sufficient for about 10 to 15 regeneration cycles, the container is designed to extend over a large area, that is, in addition to a sufficient width, it also has a large height. This affects the flow conditions in the salt-filled container.

In the dishwasher known from German Patent Application DE 102 04 548 A1, the salt container is divided into a salt chamber and a water inlet by a screen which is located horizontally when the door is closed. In the region above the salt, a brine chamber is formed into which opens a brine outlet. In particular, if fine-grained salt (fine salt), such as commercially available common salt, is used for regeneration, the vertical flow through the salt chamber leads to a heavy compaction of the salt, causing obstruction of the screen.

In dishwashers with salt containers in the appliance housing, it is also known to divide the salt container into a salt chamber and a brine chamber by a screen. However, here, the brine outlet does not open into the salt chamber, but, together with the water inlet, into brine chamber underneath the screen. In this context, the water inlet and the brine outlet are located on opposite sides of the brine chamber. For regeneration, a supply amount of water corresponding to the required quantity of brine is admitted to the brine chamber. The salt lying on the screen is dissolved by this raw water from below, as a result of which a brine with the desired concentration forms in the brine chamber. The next time raw water is introduced, this brine is forced into the ion exchanger. This principle can only work in the case of relatively low salt heights and screens having a very large surface area. In the case of narrow screens and high salt heights, clogging would be inherent, as described further above. Moreover, a relatively constant brine concentration can only be achieved if the brine chamber volume can hold the quantity of brine required for a regeneration cycle. In the case of the narrow salt containers in the door, this would be at the cost of the salt supply and is therefore not possible.

In dishwashers with salt containers in the appliance housing, it is also known to mount two right-angled screens in the bottom space, the screens dividing the salt container into a salt chamber and two brine chambers, and the salt chamber extending into a so-called "salt trench" between the two vertical screen walls. Since the fluid flow through the salt trench is in a horizontal direction, the salt concentration is increased. The use of such screens in a high, flat salt container is not practicable. When the salt level is high, the horizontal screens become clogged, and the salt is dissolved only in the region of the salt trench. Only a small amount of additional salt slides down over the right-angled edge, which results in a subsequent decrease in the salt concentration. When the salt level is low, water is also flushed through the horizontal screens because these screens are now no longer clogged. This results in a sharp increase in the brine concentration. Consequently, the known screen system with salt trench causes a considerable variation in concentration.

SUMMARY OF THE INVENTION

It is therefore an object of the present invention to provide a dishwasher of the type mentioned at the outset whose salt container, together with the brine chamber, can be integrated into the door of the dishwasher, and allows producing an optimum salt concentration.

The present invention provides a dishwasher including: a washing tub which is closable by an appliance door and a water softener including an ion exchanger and a salt container. The salt container is a flat component which includes two side walls, a bottom, and narrow connecting walls and is located in a space in the region of the door. The salt container has a water inlet and a brine outlet which are separated from each other by at least one screen surface, wherein dividing walls are mounted in the salt container. The dividing walls in each case extend from the side walls to the bottom, dividing the salt container into a water distribution duct including the water inlet, a salt chamber, and a brine collecting duct including the brine outlet. The dividing walls have regions which are aligned in a v-shape relative to each other and are designed as screen surfaces in each case only in the region adjacent to the bottom.

Due to the inventive design of the salt container, a nearly constant brine concentration is achieved independently of the salt level. This is possible because the salt is compacted downward due to the inclined, converging regions of the dividing walls. Since the screens are located near the bottom, the flow passes only through this compacted region, and addition salt can always slide down from above.

In an embodiment, the dividing walls have a support shoulder in the region adjacent to the side walls. In this manner, the level-dependent pressure on the salt is markedly reduced in the region of the screens. Thus, the brine concentration only depends on structural and therefore freely selectable parameters such as screen height, angle of inclination of the inclined walls, width of the trench, and flow rate of the water.

Moreover, in an embodiment the screen surfaces vary in height along the respective dividing wall. Thus, if the salt container has narrowings due to design requirements, changes in the salt density in the screen region can be compensated for.

In a further embodiment the water distribution duct and/or the brine collecting duct are provided with a vent opening in the rear region as viewed in the direction of flow, the vent opening connecting the respective duct to the ambient air via a vent line. Since a salt container mounted in the door is filled with salt through an opening which is oriented in a vertical direction when the dishwasher is in operation (with the door closed), the salt container cannot be completely filled with water. For this reason, an air cushion forms in the upper region of the container from where very fine bubbles are carried away during brine exchange. Moreover, trapped air is already present in the raw water itself This air clogs the screen and causes concentration variations in the brine.

In an embodiment the water distribution duct and/or the brine collecting duct each have an air-guiding channel which slopes upward toward the vent opening when the door is closed. Due to this, the air bubbles are carried away to the vent openings in a simple manner. In an expedient embodiment, provision is made for the air-guiding channel to be formed by an intermediate wall which is located between the screen surface and the support shoulder and extends from the dividing wall to the side wall, and by a section of the dividing wall and of the side wall.

BRIEF DESCRIPTION OF THE DRAWINGS

Exemplary embodiments of the present invention are shown in the drawings in purely schematic way and will be described in more detail below. In the drawings.

DETAILED DESCRIPTION

Figure 1:
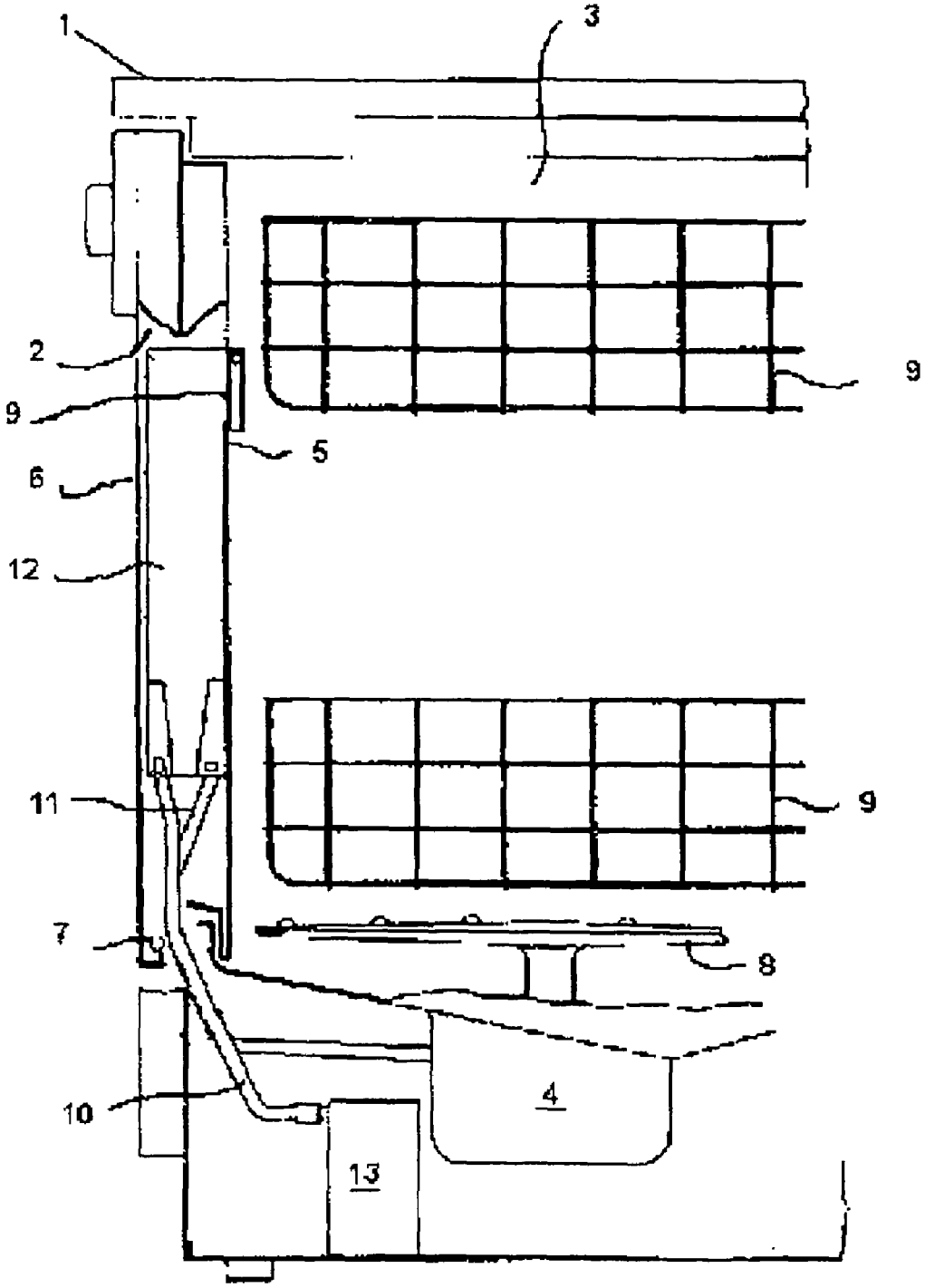
FIG. 1 shows a schematic sectional view of a dishwasher.

FIG. 1 shows a program-controlled household dishwasher having a washing tub 3 which includes a drain pain 4 and is located in a housing 1, and which can be closed by a door 2 at the front. The two-panel door 2 is composed of an inside door panel 5 and an outside door panel 6 and is supported at its bottom section on the appliance body in such a manner that it can pivot about a horizontally extending axis 7. A lower spray arm is denoted by 8 and two dish racks are referred to by 9. The supply of wash water to spray arm 8 via a circulating pump is sufficiently known and therefore not shown in the drawings. The same applies to the supply of water to the washing tub 3 and to the drainage of the drain pan 4 via a drain pump.

To be able to use softened wash water in at least one program cycle, the dishwasher 1 is equipped with an integrated water softener. This water softener includes an ion exchanger 13 and a container which is intended to hold the regenerant NaCI and is therefore referred to as "salt container 12" hereinafter. The raw water is supplied from a water line system of the dishwasher via a valve-controlled water connection. Ion exchanger 13 is located in housing 1 underneath drain pan 4; salt container 12 is mounted in door 2 in the space between inside door panel 5 and outside door panel 6. A brine outlet line 10 runs from salt container 12 to the ion exchanger. Water is supplied from a reservoir in a water bag via a water supply line 11. Lines 10, 11 are designed as flexible hose connections at least in the moving portion of the door.

Figure 2:
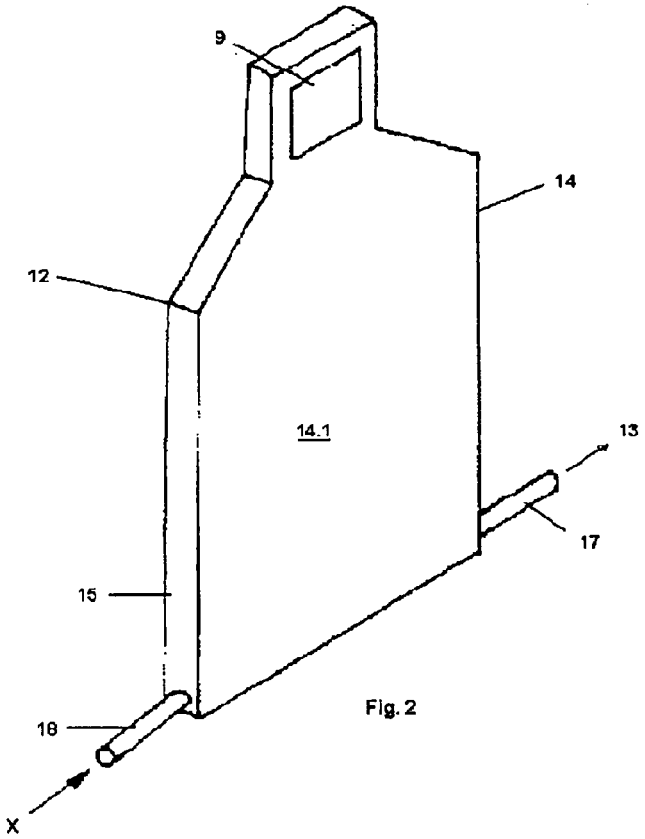
FIG. 2 shows a perspective view of a salt container.

FIG. 2 is a detail view of salt container 12. The salt container is made of plastic (polypropylene) and composed of two side walls 14 which have a large surface area and of which the wall 14.1 facing the inside door panel 5 is provided with a closable salt fill opening 9. The two side walls 14 are completed by narrow connecting walls 15 and a likewise narrow bottom 16 (shown in FIGS. 3*a* and 4) into a flat container which has a cuboidal shape in the lower region from where it tapers towards fill opening 9 in a trapezoidal shape. Connecting walls are provided with openings on both sides in the lower regions, the openings having pipe connectors 17, 18 integrally formed thereon. Water supply line 11 is connected to the front connector 18; brine outlet line 10 is connected to the rear connector 17.

Figure 3:
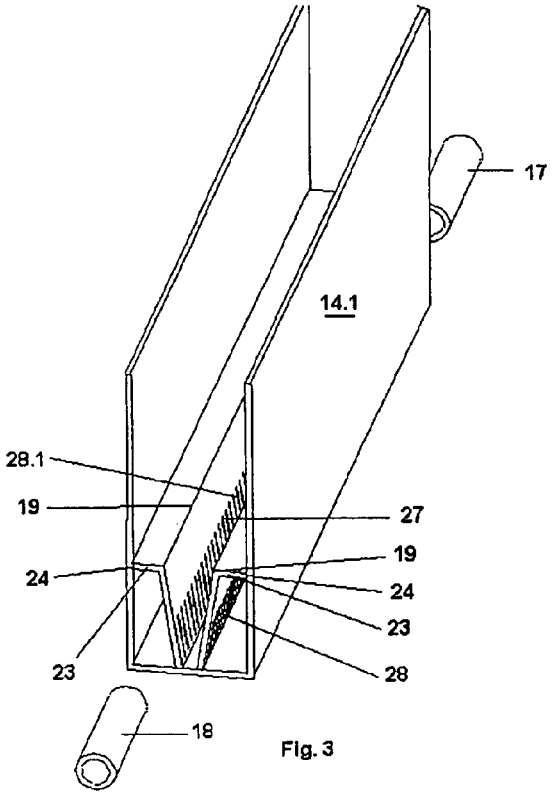
FIGS. 3, 3*a* show a partial section through a simplified embodiment of salt container as viewed in the X direction.
Figure 3A:
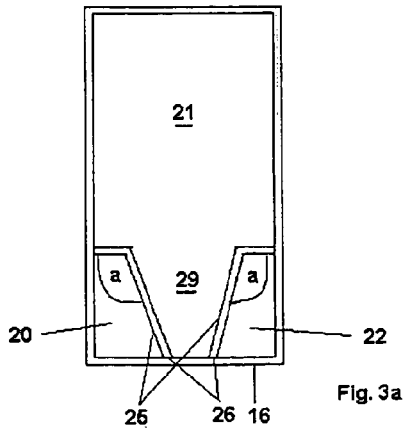
Figure 5:
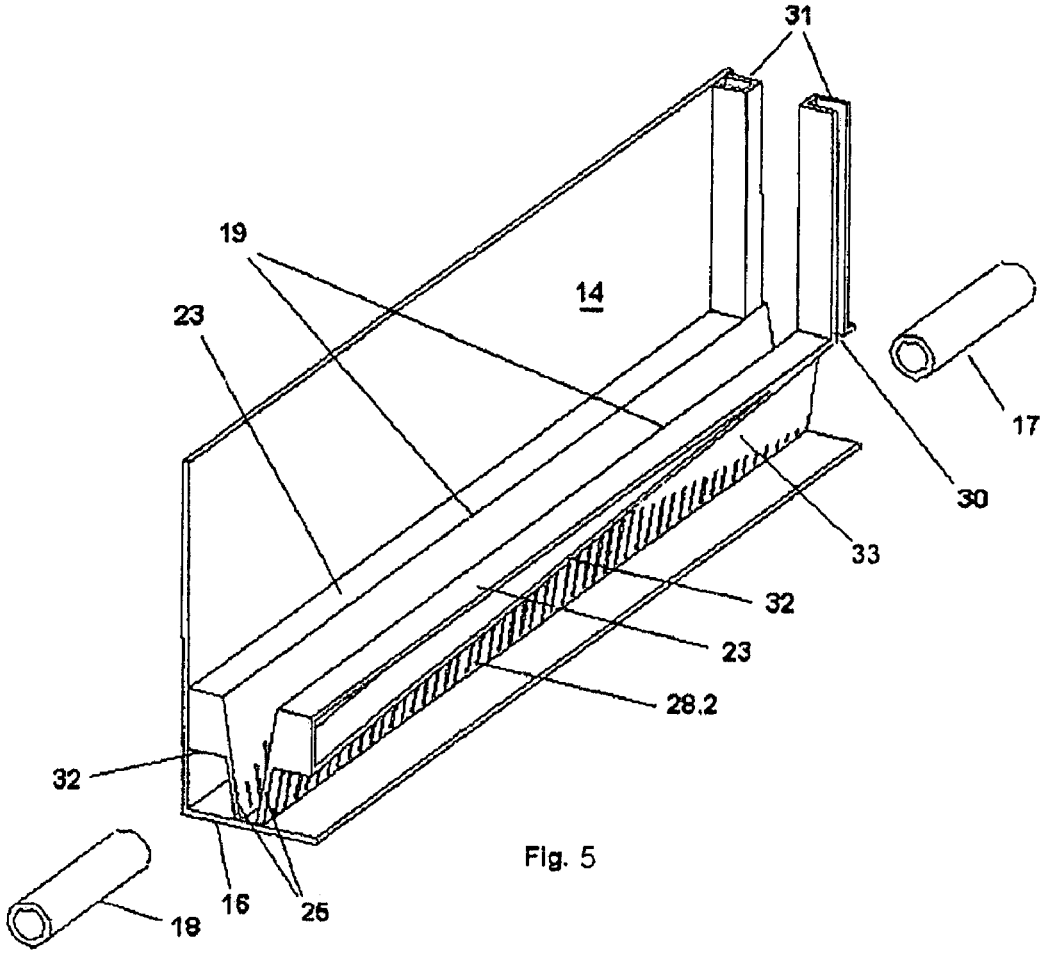
FIG. 5 shows a partial section through salt container including a vent, with the right side wall removed, where the screen surfaces vary in height alone the respective dividing wall.

FIGS. 3 and 3*a* show the interior of a simplified embodiment of the salt container. The salt container is divided by two dividing walls 19 into a water distribution duct 20 including the water inlet, a salt chamber 21, and a brine collecting duct 22 including the brine outlet. Dividing walls 19 are designed as angle sections, each extending over nearly the full width of salt container 12. The dividing walls are made as separate parts and connected to salt container 12 by welding. Alternatively, salt container 12 and dividing walls 19 can also be integrally injection-molded as a single piece; which, however, is difficult to accomplish because of problems during the removal from the mold. Due to the angular shape, the first legs 23 act as support shoulders which are aligned parallel to the bottom 16 of salt container 12. The free edges 24 of these legs contact the side walls 14. The other legs 25 contact the bottom 16 of salt container 12 with their free edges 26. The latter legs are provided with about 0.2 mm wide slits 27 only in the region adjacent to bottom 16; the slits in each case forming a screen, or sieve, surface 28. In the exemplary embodiment shown, the screen slits 27 have a constant height. However, the height can also vary, as shown in FIG. 5, which is useful especially if salt container 12 has installation-related constrictions above the region between legs 25 (salt trench). The two legs 23 and 25 of a dividing wall 19 from an angle a greater than 90°. Accordingly, the lower legs 25 of the two dividing walls 19 are aligned in a v-shape relative to each other, forming a salt trench 29 of trapezoidal cross section; the narrower of the two parallel sides (bases) being formed by bottom 16.

Figure 4:
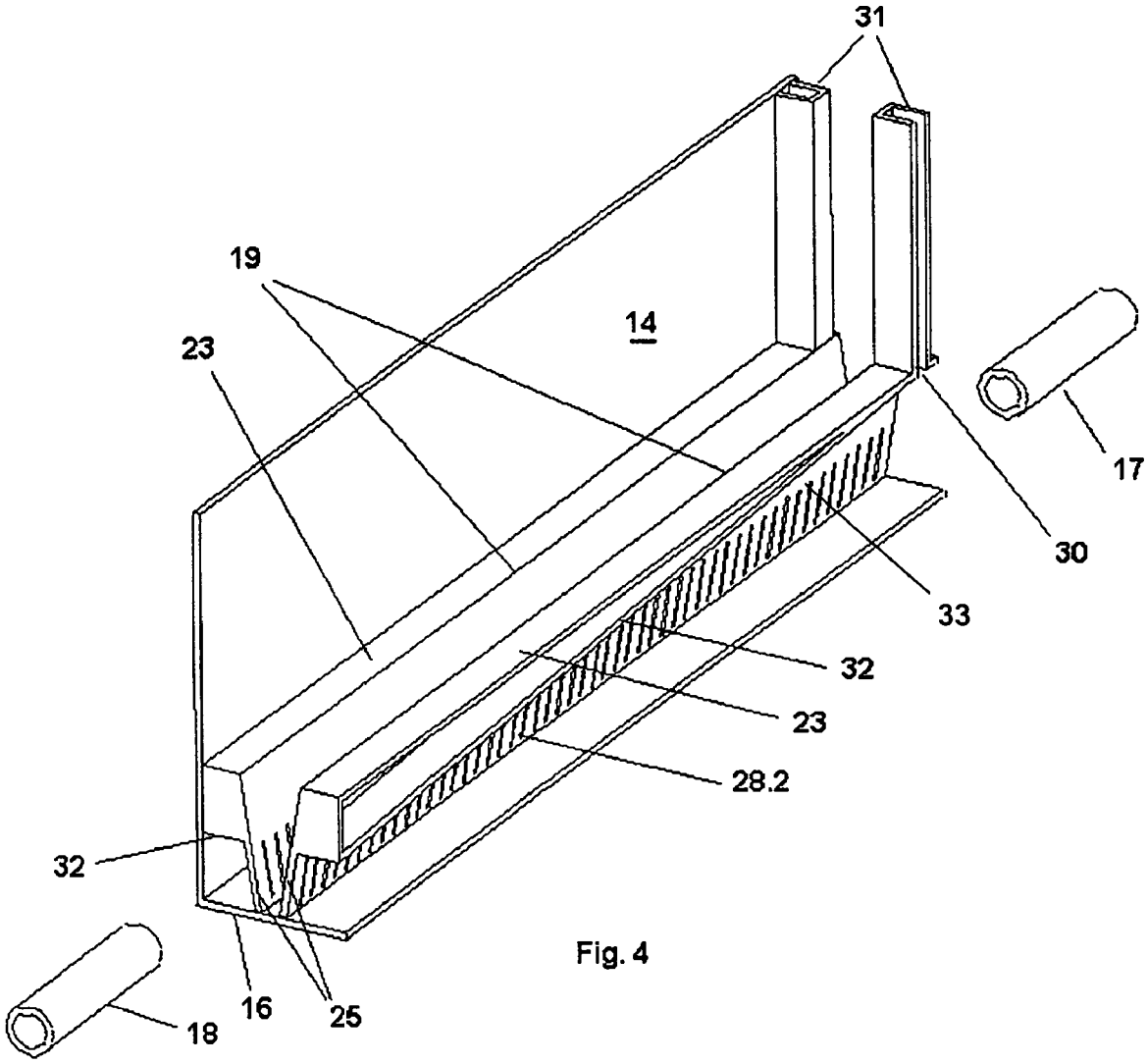
FIG. 4 shows a partial section through salt container including a vent, with the right side wall removed.

FIG. 4 shows an embodiment of a salt container 12 which is provided with a vent. To this end, horizontal legs 23 of the dividing walls 19 are provided with openings 30 which are in communication with the ambient air via vent lines 31. The openings 30 are in each case arranged at the sink end of the flow gradient in the respective duct (water distribution duct 20 and brine collecting duct 22, respectively). In the case of water distribution duct 20, this is the end opposite water inlet 18; in the case of brine collecting duct 22, this is the end at brine outlet 17. Moreover, in both ducts 20, 22, provision is made for an air-guiding channel 33 that slopes upward toward the vent opening. For this purpose, intermediate walls 32 are mounted between the screen surfaces 28 and the support shoulders (legs 23). The intermediate walls extend from the legs 25 of the dividing walls to the respective side walls 14. Thus, the air-guiding channels 33 are formed by the upwardly sloping intermediate walls 32, the adjacent sections of dividing walls 19, and by the adjacent sections of side walls 14. The air-guiding channels 33 ensure that small bubbles move up the slopes due to buoyancy and with the assistance of the fluid flow, and are carried off through openings 30 via vent lines 31 into the ambient environment.

To carry out a regeneration cycle, the supply amount of water required for this is fed from the water bag via water supply line 11 into water distribution duct 20. Thus, initially, the brine present in brine collecting duct 22 is forced into ion exchanger 13. However, since this amount of brine is not sufficient for regeneration, additional brine must be produced. To this end, additional water is forced from water distribution duct 20 through left screen 28.1 into salt trench 29, and from there through right screen 28.2 into brine collecting duct 22. In the process, the water dissolves the salt located between the screens 28 and is converted to brine. The concentration of this brine is nearly constant because the fluid flow, and thus the dissolution of salt, is primarily limited to the region between screens 28. Due to the v-shaped, inclined arrangement of the legs 25 of dividing walls 19, the salt is compacted in the region of screens 28. Moreover, it is ensured that addition salt constantly slides down from the space above salt trench 29. Pressure exerted by the salt volume present above salt trench 29 is supported by the support shoulders (legs 23). After the supply of water has been completely emptied, a residual amount of water remains in water distribution duct 20, and a residual amount of brine remains in brine collecting duct 22. These residual amounts of water and brine are transported into ion exchanger 13 during the next regeneration cycle.

What is claimed is:

1. A dishwasher comprising:

a door;

a washing tub closable by the door;

a water softener including an ion exchanger and a salt container, the salt container being disposed in an area of the door and being a flattened component including a first and a second side wall, a bottom, and narrow connecting walls, the salt container including a water inlet and a brine outlet; and a first and a second dividing wall disposed in the salt container, the first dividing wall extending from the first side wall to the bottom and the second dividing wall extending from the second side wall to the bottom so as to divide the salt container into a water distribution duct including the water inlet, a salt chamber, and a brine collecting duct including the brine outlet, the first and second dividing walls each including a respective screen surface in a respective region of the respective dividing wall adjacent to the bottom, the screen surfaces being disposed a v-shape relative to each other, the screen surfaces separating the water inlet and a brine outlet from each other.

2. The dishwasher as recited in claim 1 wherein the first dividing wall includes a first support shoulder in a region of the first dividing wall adjacent to the first side wall and the second dividing wall includes a second support shoulder in a region of the second dividing wall adjacent to the second side wall.

3. The dishwasher as recited in claim 1 wherein each of the respective screen surfaces varies in height along the respective dividing wall.

4. The dishwasher as recited in claim 1 wherein at least one of the water distribution duct and the brine collecting duct includes a vent opening in a respective rear region as viewed in a respective direction of flow, the respective vent opening connecting the respective duct to ambient air via a respective vent line.

5. The dishwasher as recited in claim 4 wherein at least one of the water distribution duct and the brine collecting duct includes a respective air-guiding channel configured to slope upward toward the respective vent opening when the door is closed.

6. The dishwasher as recited in claim 5 wherein each of the respective dividing walls includes a support shoulder extending from the respective side wall, and further comprising a respective intermediate wall disposed between the respective support shoulder and the respective screen surface of the dividing wall and extending from the respective dividing wall to the respective side wall, the respective air-guiding channel being formed by the respective intermediate wall, a portion of the respective dividing wall, and the respective side wall.

* * * * *